US005532118A

United States Patent [19]

Bauer et al.

[11] Patent Number: 5,532,118

[45] Date of Patent: Jul. 2, 1996

[54] LIGHT-SENSITIVE IMAGING ELEMENT

[75] Inventors: Charles L. Bauer, Webster; Mary A. Krenceski, Delmar; John J. Fitzgerald, Clifton Park, all of N.Y.

[73] Assignee: Eastman Kodak Company, Rochester, N.Y.

[21] Appl. No.: 459,247

[22] Filed: Jun. 2, 1995

[51] Int. Cl.[6] ..... G03C 1/79

[52] U.S. Cl. ..... 430/533; 430/523; 430/537; 430/935; 430/937

[58] Field of Search ..... 430/523, 531, 430/532, 533, 537, 935, 937; 428/423.7, 336

[56] References Cited

U.S. PATENT DOCUMENTS

| | | | |
|---|---|---|---|
| 3,143,421 | 8/1964 | Nadeau et al. | 430/535 |
| 3,201,249 | 8/1965 | Pierce et al. | 430/514 |
| 4,335,029 | 6/1982 | Dabi et al. | 524/589 |
| 4,695,532 | 9/1987 | Ponticello et al. | 430/533 |
| 4,913,970 | 4/1990 | Hayward et al. | 428/423.7 |
| 4,933,237 | 6/1990 | Krenceski et al. | 428/423.7 |
| 5,034,275 | 7/1991 | Pearson et al. | 428/336 |
| 5,378,592 | 1/1995 | Nakanishi et al. | 430/533 |

FOREIGN PATENT DOCUMENTS

| | | |
|---|---|---|
| 0583787A2 | 2/1994 | European Pat. Off. . |

*Primary Examiner*—Hoa Van Le
*Attorney, Agent, or Firm*—Robert A. Gerlach

[57] ABSTRACT

An imaging element comprising a light-sensitive imaging layer and a polyester film support having coated thereon greater than 0.17 gm/m$^2$ of a layer of a self-crosslinking polyurethane derived from an isocyanate terminated prepolymer extended with an aliphatic polyamine and end-capped with N-methylol hydrazide groups, the prepolymer being derived from (a) a diisocyanate, and (b) a polyester polyol and having pendant water dispersing, carboxylic salt groups on the polymer chain.

10 Claims, No Drawings

LIGHT-SENSITIVE IMAGING ELEMENT

BACKGROUND OF THE INVENTION

1. Field of the Invention

This invention relates to light-sensitive imaging elements and particularly to photographic elements having a polyester film support with an adhesion promoting layer on at least one surface of the polyester support.

2. Description of Related Art

It is difficult to adhere photographic emulsions to oriented polyester supports, such as polyethylene terephthalate and polyethylene naphthalate. This problem is exacerbated by the conditions to which photographic elements are subjected; i.e., the adhesion must not fail in the raw and processed dry state, as well as when the film is wet during the development process.

Several subbing materials, such as poly(methyl acrylate-co-vinylidene chloride-co-itaconic acid) and poly(acrylonitrile-co-vinylidene chloride-co-acrylic acid) disclosed in U.S. Pat. Nos. 3,201,249 and 3,143,421, respectively, provide the required adhesion when applied before orientation but are not as effective when applied on oriented support. The effectiveness of these adhesive materials may be enhanced by the use of swelling or attack agents such as resorcinol.

An alternative approach disclosed in U.S. Pat. No. 4,695,532 describes a discharged treated polyester film support having coated directly thereon a crosslinked layer of an aqueous vinyl acrylate copolymer and gelatin mixture. Although this system has good adhesion before processing, the adhesion performance is severely degraded by photographic developing solutions.

EP 0583787 A2 discloses the use of glow discharge treatment to enhance the adhesion of photographic elements. This treatment involves the use of high energy plasma under vacuum which requires specific equipment.

U.S. Pat. No. 5,378,592 discloses the use of a subbing layer (for photographic materials) that comprises a polyurethane latex cured with an epoxy compound or a dichloro-s-triazine derivative. It is not a self-crosslinkable polyurethane.

It is desirable to provide polyester film supports having improved wet and dry adhesion of hydrophilic colloid emulsions. It is also desirable to provide such supports that are free of photosensitive active materials.

SUMMARY OF THE INVENTION

This invention provides an imaging element having a polyester support and at least one light-sensitive imaging layer, the support having at least one surface coated with greater than 0.17 g/m$^2$, preferably from 0.18 to 0.55 g/m$^2$, of a self-crosslinking polyurethane derived from a polyurethane prepolymer chain extended with an aliphatic polyamine and end-capped with N-methylol hydrazide groups, the prepolymer being derived from (a) a diisocyanate and (b) a polyester polyol and having pendant water dispersing, carboxylic salt groups on the polymer chain.

DESCRIPTION OF PREFERRED EMBODIMENTS

In the process of making a photographic element in accordance with this invention, the polyurethane adhesive promoting layer may be applied to the polyester film support either during the preparation of the film support or subsequently thereto. That is, in the preparation of polyester film supports, the polymer is melt extruded into a sheet and subsequently oriented by stretching in both the machine and transverse directions and subsequently treated by several steps including heat treating, heat relaxing, annealing, and the like. This procedure is well known in the art and requires no further explanation. The polyurethane adhesive promoting layer may be applied at any stage in the known process of preparing polyester photographic film base, including before orienting, between the orienting steps, or before or after any of the subsequent steps in the preparation of the support. The application of the polyurethane adhesive promoting layer is particularly advantageous after completion of the polyester support because it provides adhesion not attributable to previously known subbing layers when applied at this point.

Suitable polyester film supports are polymeric linear polyesters of bifunctional aromatic dicarboxylic acids and dihydroxy organic compounds. Generally, they are polyesters derived from terephthalic acid or naphthalene dicarboxylic acids and alkylene glycols. Polyester film supports are well known and can be prepared from any of the polyester compositions described, for example, in Nadeau U.S. Pat. No. 2,943,937 or in Alles et al., U.S. Pat. No. 2,627,088. Suitable polyester for use as supports include those prepared from dicarboxylic acids or derivatives thereof, such as terephthalic acid, isophthalic acid, 2,6-naphthalene dicarboxylic acid, 2,7-naphthalene dicarboxylic acid, adipic acid, succinnic acid and mixtures thereof and glycols, such as, ethylene glycol, propylene glycol, butylene glycol, hexamethylene glycol, cyclohexane diol, 1,4-cyclohexane dimethylol, and mixtures thereof. Especially useful polyester film supports are poly(ethylene terephthalate) or poly(ethylene naphthalate).

The supports preferably are initially treated with corona discharge (CDT), UV, glow discharge (GDT), flame or other such methods that alter the support surface. The preferred method is glow discharge treatment as described in U.S. application Ser. No. 07/199,416 filed Feb. 22, 1994; U.S. Pat. Nos. 3,288,638; 3,837,886; 4,451,497; 4,933,267; and EPO application 92/3035562, all of which are incorporated herein by reference.

The self-crosslinking polyurethane layer is applied to the polyester film support from an aqueous dispersion.

Dispersions of this kind are described in detail in the patent to Dabi et al., U.S. Pat. No. 4,335,029 issued Jun. 15, 1982, which is incorporated by reference herein.

According to the Dabi et al. patent, the self-crosslinking polyurethane is derived from an NCO-containing prepolymer. To make the polyurethane, the prepolymer is chain extended with an aliphatic polyamine chain extender such as an alkylene diamine or triamine. Preferably, the chain extender is a triamine-containing polyamine such as a mixture of a lower alkylene diamine and a lower alkylene triamine. Especially preferred is a mixture of ethylene diamine and diethylene triamine. After chain extension, a dihydrazide end-capper such as adipic dihydrazide is added to the dispersion. The resulting hydrazide end-capped prepolymer is then partially or completely N-methylolated with formaldehyde. The polyurethane is thus provided with internal crosslinking, curable hardening groups activated to self-condensation and crosslinking upon drying of the latex film on a substrate at room or elevated temperature.

The prepolymer for the polyurethane is a derivative of a polyester polyol prepared from aliphatic diols and an aliphatic dicarboxylic acid. The preferred prepolymer is derived from neopentyl glycol, hexanediol and adipic acid. The prepolymer is NCO-terminated and contains units in the chain derived from melamine and pendant water-dispersing carboxylic salt groups. To synthesize the prepolymer, the polyester polyol is reacted with melamine and an aliphatic diisocyanate such as 4,4'-bis(isocyanatocyclohexyl-)methane. Carboxylic salt groups are attached to the chain by reaction with an alpha, alpha-dimethylol $C_{2-10}$ alkanoic acid such as 2,2-dimethylol propionic acid followed by neutralization with a salt forming agent such as tertiary amine, e.g., triethylamine. Through the use of appropriate diluents and agitation during preparation of the polyurethane, as described in the Dabi et al. patent, a latex dispersion is obtained. This can be further diluted with water or solvents to obtain the optimum viscosity for coating the polyester support.

A specific and preferred example, which applicants believe from their own analysis and from the disclosure of Dabi et al. to be such a self-crosslinking dispersion, is "Witcobond W-240" dispersion, a product of Witco Corporation of Houston, Tex. 77245. Typical properties of Witcobond W-240 dispersion are listed in Table 1.

TABLE 1

| | |
|---|---|
| Appearance | Translucent |
| Solids, % | 30 |
| Particle Charge | Anionic |
| Particle Size | Colloidal |
| pH at 25° C. | 8.5 |
| Viscosity at 25° C.(77° F.) Brookfield LVF, cps | <75 |
| Flash Point, Tag Closed Cup, °C. | >100 |
| Fugitive Organic Volatiles, weight % | 13.4 |
| Surface Tension, dynes/cm | 54 |
| Density, lb/gal | 8.724 |
| Specific Gravity at 25° C. | 1.05 |
| Glass Transition Temperature (Tg), °C. | −53 |
| Shear Stability | Excellent |
| Freeze-Thaw Stability (−18° C.) | Excellent after 6 cycles |
| Tensile Strength at Yield, psi | 6000 |
| Ultimate Elongation, % | 70 |
| Hydrolytic Stability | Excellent |

Any suitable hydrophilic colloid layer may be applied over the self-crosslinking polyurethane layer in accordance with this invention such as, those set forth in U.S. Pat. No. 5,405,741, incorporated herein by reference. Gelatin is the preferred material. Any suitable type of gelatin may be used, such as, acid or lime processed gelatin. Acid processed, deionized gelatin is preferred in this application. A hardening agent such as chrome alum and matte particles such as poly(methyl methacrylate) beads may be added to the gel sub if desired. For coatability, any surfactants such as Olin 10G, Saponin or Alkanol-XC may be used.

Photographic elements in accordance with this invention include at least one photosensitive layer. Such photosensitive layers can be image-forming layers containing photographic silver halides such as silver chloride, silver bromide, silver bromoiodide, silver chlorobromide and the like. Both negative and reversal silver halide elements are contemplated. For reversal films, the emulsion layers as taught in U.S. Pat. No. 5,236,817, especially Examples 16 and 21, are particularly suitable. Any of the known silver halide emulsion layers, such as those described in *Research Disclosure,* Vol. 176, December 1978 Item 17643 and *Research Disclosure* Vol. 225, January 1983 Item 22534, the disclosures of which are incorporated by reference in their entirety, are useful in preparing photographic elements in accordance with this invention. Generally, the photographic element is prepared by coating the subbed support film with one or more layers comprising a dispersion of silver halide crystals in an aqueous solution of gelatin. The coating process can be carried out on a continuously operating machine wherein a single layer or a plurality of layers are applied to the support. For multicolor elements, layers can be coated simultaneously on the composite support film as described in U.S. Pat. No. 2,761,792 and U.S. Pat.. No. 3,508,947. Additional useful coating and drying procedures are described in *Research Disclosure*, Vol. 176, December 1978, Item 17643. Suitable photosensitive image forming layers are those which provide color or black and white images.

The photographic elements according to this invention can contain one or more conducting layers such as antistatic layers and/or anti-halation layers such as described in *Research Disclosure,* Vol. 176, December 1978, Item 17643 to prevent undesirable static discharges during manufacture, exposure and processing of the photographic element. Antistatic layers conventionally used in-color films have been found to be satisfactory for use herewith. Any of the antistatic agents set forth in U.S. Pat. No. 5,147,768, which is incorporated herein by reference may be employed. Preferred antistats include metal oxides, for example, tin oxide, antimony doped tin oxide and vanadium pentoxide, silver doped vanadium pentoxide and mixtures thereof.

The photographic elements according to this invention can be provided on the side opposite to the emulsion layers with a transparent magnetic recording layer as described in U.S. Pat. No. 5,397,826, which is incorporated herein by reference. Further, the outermost layer on either side of the photographic element may contain a lubricant, such as a wax in, on or over the transparent magnetic recording layer. Suitable lubricants include silicone oil, silicones having polar groups, fatty acid-modified silicones, fluorine-containing silicones, fluorine-containing alcohols, fluorine-containing esters, polyolefins, polyglycol alkyl phosphates and alkali metal salts thereof, alkyl sulfates and alkali metal salts thereof, polyphenyl ethers, fluorine-containing alkyl sulfates and alkali metal salts thereof, monobasic fatty acids having 10 to 24 carbon atoms (which may contain unsaturated bonds or may be branched) and metal salts thereof (such as Li, Na, K and Cu), monovalent, divalent, trivalent, tetravalent, pentavalent, and hexavalent alcohols having 12 to 22 carbon atoms, (which may contain unsaturated bonds or may be branched), alkoxy alcohols having 12 to 22 carbon atoms, mono-, di- and tri-esters of monobasic fatty acids having 10 to 24 carbon atoms (which may contain unsaturated bonds or may be branched) and one of monovalent, divalent, trivalent, tetravalent, pentavalent, and hexavalent alcohols having 2 to 12 carbon atoms (which may contain unsaturated bonds or may be branched), fatty acid esters of monoalkyl ethers of alkylene oxide polymers, fatty acid amides having 8 to 22 carbon atoms and aliphatic amines having 8 to 22 carbon atoms.

Specific examples of these compounds (i.e., alcohols, acids or esters) include lauric acid, myristic acid, palmitic acid, stearic acid, behenic acid, butyl stearate, oleic acid, linoleic acid, linolenic acid, elaidic acid, octyl stearate, amyl stearate, isooctyl stearate, octyl myristate, butoxyethyl stearate, anhydrosorbitan monostearate, anhydrosorbitan distearate, anhydrosorbitan tristearate, pentaerythrityl tetrastearate, oleyl alcohol and lauryl alcohol. Carnauba wax is preferred.

The invention will be further illustrated by the following example.

EXAMPLE 1

The following layers are coated in order on a 4 mil oriented and annealed polyethylene naphthalate (A-PEN) support:

1) A-1: Witcobond W240 (coverage indicated below).

2) a gelatin layer (gel sub) at 0.11 g/m$^2$ containing Type V gelatin with 2 wt % chrome alum and 0.1% (by wt of total solution mass) Triton X-100 (Rohm & Haas) as surfactant.

3) a gelatin silver halide emulsion layer (antihalation layer, approximately 19.8 g/m$^2$).

Corona discharge treating (200 watts at 6.1 m/min (20 ft/min)) is used prior to coating the Witcobond W240 and the gel sub, except where noted. As a comparison, C-1, a Poly(n-butylacrylate-co-2-aminoethyl methacrylate hydrochloride-co-2-hydroxyethyl methacrylate) (50/5/45 wt ratio)/gel 85/15 sub is coated as disclosed in U.S. Pat. No. 4,695,532. The coating solutions are applied using a coating hopper and dried for a time sufficient to remove water.

Samples are incubated (24 hours, 32.2° C./50% RH) and evaluated for both wet and dry adhesion in the following manner (results in Table 2):

Dry Adhesion: 610 Scotch Tape Test The coating is scored with a razor blade in a grid pattern (5 one inch lines, 0.2 inches apart and another 5 at a 45 degree angle to the first set). A piece of 610 Scotch tape is applied over the scored area and the tape is pulled off by hand. The amount of adhesion is ranked in the following manner: Good–no removal of the coating, Fair=slight removal, Poor=substantial removal of the coating.

Wet Adhesion: AO abrasion A 35 mm strip of the coating is soaked at 100° F. for 3 min 15 sec. in Kodak Flexicolor Developer Replenisher. The strip is then scored with a razor blade and placed in a small trough filled with developer solution. A weighted (900 g) filled natural rubber pad, 3.49 cm diameter, is placed on top. The pad is moved back and forth across the strip 100 times. The amount of removal is then assessed given in units of % removed.

TABLE 2

| Sample # | Support | CDT before sub | Sub | CDT before gel | Gel overcoat | Dry Adhesion | Wet Adhesion |
|---|---|---|---|---|---|---|---|
| 1 (comparison) | A-PEN | Yes | C-1, 0.385 g/m$^2$ | — | none | Good | 5% |
| 2 (comparison) | A-PEN | Yes | A-1, 0.110 g/m$^2$ | Yes | Yes | Good | 100% |
| 3 | A-PEN | Yes | A-1, 0.176 g/m$^2$ | Yes | Yes | Good | 0% |
| 4 | A-PEN | Yes | A-1, 0.253 g/m$^2$ | Yes | Yes | Good | 0% |
| 5 | A-PEN | Yes | A-1, 0.330 g/m$^2$ | Yes | Yes | Good | 0% |
| 6 | A-PEN | Yes | A-1, 0.330 g/m$^2$ | No | Yes | Good | 0% |
| 7 | A-PEN | No | A-1, 0.330 g/m$^2$ | Yes | Yes | Poor | 100% |
| 8 | PET* | Yes | A-1, 0.330 g/m$^2$ | Yes | Yes | Good | 0% |

*4 mil polyethylene terephthalate

This data shows that the use of the Witcobond W240 above 0.110 g/m$^2$ with a corona discharge treated support provides good wet and dry adhesion.

EXAMPLE 2

Photographic elements are prepared by coating the following layers in order on the Witcobond W-240/gel subbed 4 mil oriented and annealed polyethylene naphthalate support that is corona discharge treated as in Sample 5 of Example 1. The coating solutions are applied using a coating hopper and dried for a time sufficient to remove water. The quantities of silver halide are given in grams of silver per m$^2$. The quantities of other materials are given in g per m$^2$.

Layer 1 {Antihalation Layer} black colloidal silver sol containing 0.236 g of silver, with 2.44 g gelatin.

Layer 2 {First (least) Red-Sensitive Layer} Red sensitized silver iodobromide emulsion [1.3 mol % iodide, average grain diameter 0.55 microns, average thickness 0.08 microns] at 0.49 g, red sensitized silver iodobromide emulsion [4 mol % iodide, average grain diameter 1.0 microns, average thickness 0.09 microns] at 0.48 g, cyan dye-forming image coupler C-1 at 0.56 g, cyan dye-forming masking coupler CM-1 at 0.033 g, BAR compound B-1 at 0.039 g, with gelatin at 1.83 g.

Layer 3 {Second (more) Red-Sensitive Layer} Red sensitive silver iodobromide emulsion [4 mol % iodide, average grain diameter 1.3 microns, average grain thickness 0.12 microns] at 0.72 g, cyan dye-forming image coupler C-1 at 0.23 g, cyan dye-forming masking coupler CM-1 at 0.022 g, DIR compound D-1 at 0.011 g, with gelatin at 1.66 g.

Layer 4 {Third (most) Red-Sensitive Layer} Red sensitized silver iodobromide emulsion [4 mol % iodide, average grain diameter 2.6 microns, average grain thickness 0.13 microns] at 1.11 g, cyan dye-forming image coupler C-1 at 0.13 g, cyan dye-forming masking coupler CM-1 at 0.033 g, DIR compound D-1 at 0.024 g, DIR compound D-2 at 0.050 g, with gelatin at 1.36 g.

Layer 5 {Interlayer} Yellow dye material YD-1 at 0.11 g and 1.33 g of gelatin

Layer 6 {First (least) Green-Sensitive Layer} Green sensitized silver iodobromide emulsion [1.3 mol % iodide, average grain diameter 0.55 microns, average grain thickness 0.08 microns] at 0.62 g, green sensitized silver iodobromide emulsion [4 mol % iodide, average grain diameter 1.0 microns, average grain thickness 0.09 microns] at 0.32 g, magenta dye-forming image coupler M-1 at 0.24 g, magenta dye-forming masking coupler MM-1 at 0.067 g with gelatin at 1.78 g.

Layer 7 {Second (more) Green-Sensitive Layer} Green sensitized silver iodobromide emulsion [4 mol % iodide, average grain diameter 1.25 microns, average grain thickness 0.12 microns] at 1.00 g, magenta dye-forming image coupler M-1 at 0.091 g, magenta dye-forming masking coupler FIM-1 at 0.067 g, DIR compound D-1 at 0.024 g with gelatin at 1.48 g.

Layer 8 (Third (most) Green-Sensitive Layer) Green sensitized silver iodobromide emulsion [4 mol % iodide, average grain diameter 2.16 microns, average grain thickness 0.12 microns] at 1.00 g, magenta dye-forming image coupler M-1 at 0.072 g, magenta dye-forming masking coupler MM-1 at 0.056 g, DIR compound D-3 at 0.01 g, DIR compound D-4 at 0.011 g, with gelatin at 1.33 g.

Layer 9 {Interlayer} Yellow dye material YD-2 at 0.11 g with 1.33 g gelatin.

Layer 10 {First (less) Blue-Sensitive Layer} Blue sensitized silver iodobromide emulsion [1.3 mol % iodide, average grain diameter 0.55, average grain thickness 0.08 microns] at 0.24 g, blue sensitized silver iodobromide emulsion [6 mol % iodide, average grain diameter 1.0 microns, average grain thickness 0.26 microns] at 0.61 g, yellow dye-forming image coupler Y-1 at 0.29 g, yellow dye forming image coupler Y-2 at 0.72 g, cyan dye-forming image coupler C-1 at 0.017 g, DIR compound D-5 at 0.067 g, BAR compound B-1 at 0.003 g with gelatin at 2.6 g.

Layer 11 {Second (more) Blue-Sensitive Layer} Blue sensitized silver iodobromide emulsion [4 mol % iodide, average grain diameter 3.0 microns, average grain thickness 0.14 microns] at 0.23 g, blue sensitized silver iodobromide emulsion [9 mol % iodide, average grain diameter 1.0 microns] at 0.59 g, yellow dye-forming image coupler Y-1 at 0.090 g, yellow dye-forming image coupler Y-2 at 0.23 g, cyan dye-forming image coupler C-10.022 g, DIR compound D-5 at 0.05 g, BAR compound B-1 at 0.006 g with gelatin at 1.97 g.

Layer 12 {Protective Layer} 0.111 g of dye UV-1, 0.111 g of dye UV-2, unsensitized silver bromide Lippman emulsion at 0.222 g, 2.03 g.

This film is hardened at coating with 2% by weight to total gelatin of hardener H-1. Surfactants, coating aids, scavengers, soluble absorber dyes and stabilizers are added to the various layers of this sample as is commonly practiced in the art.

The formulas for the component materials are as follows:

C-1:

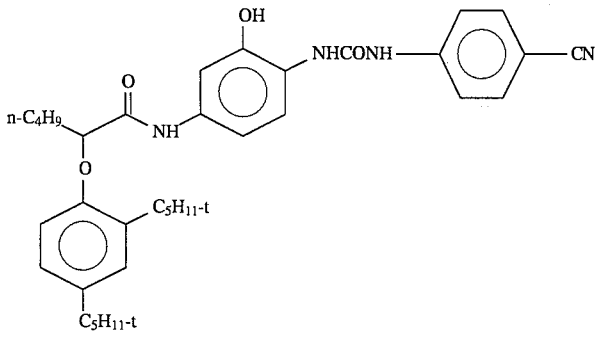

CM-1

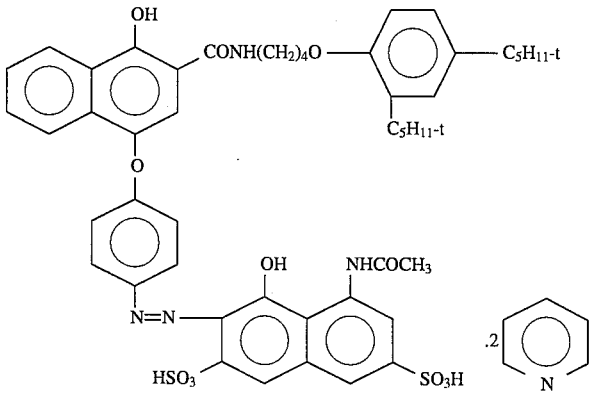

B-1

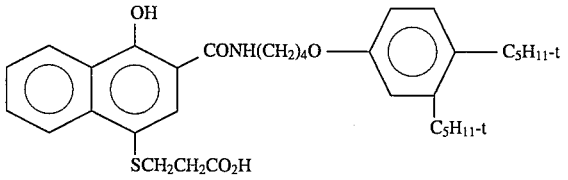

D-1:

-continued
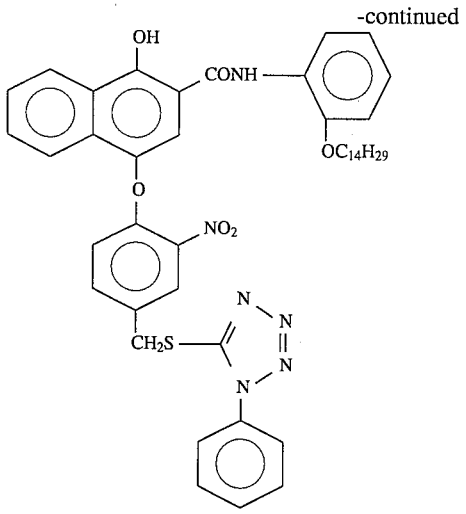
D-2
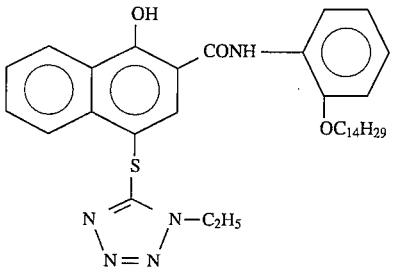
D-3:
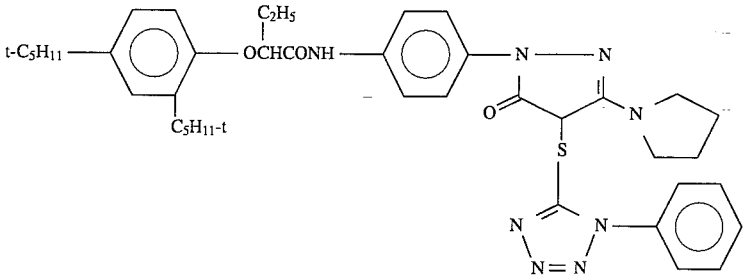
D-4
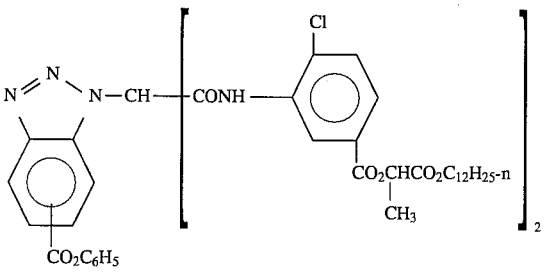
D-5:
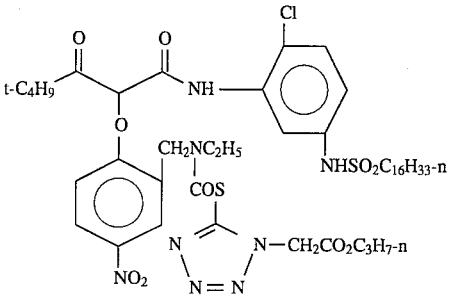

-continued
MM-1
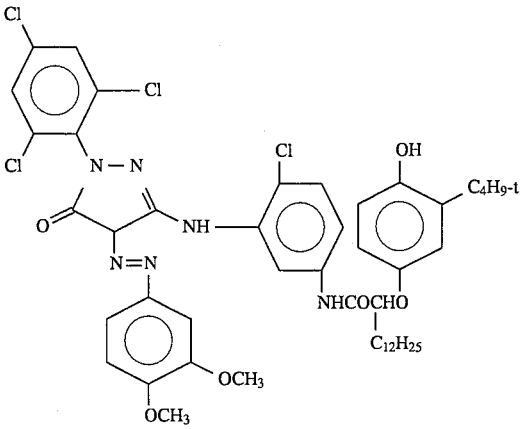
Y-1:
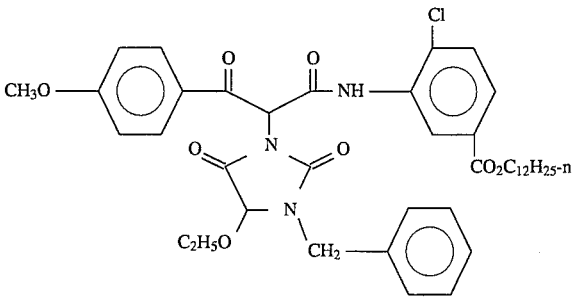
Y-2:
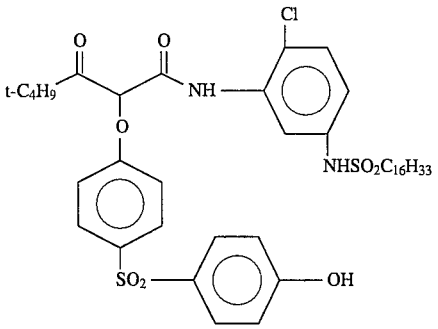
M-1:
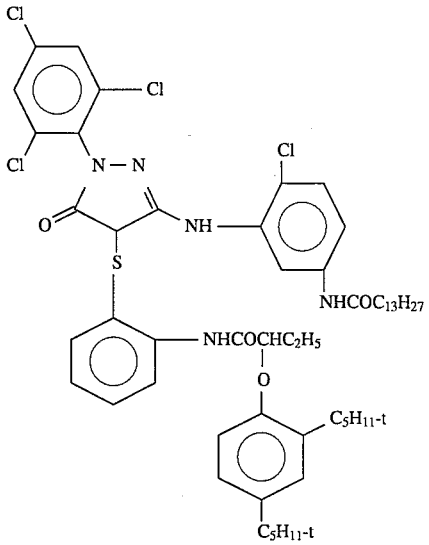

-continued

YD-1:

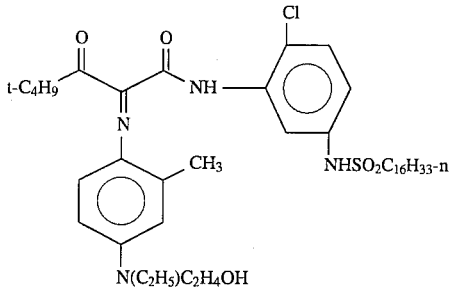

YD-2:

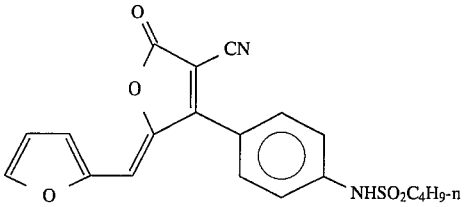

UV-1:

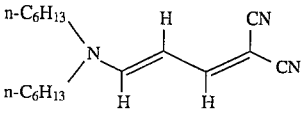

UV-2:

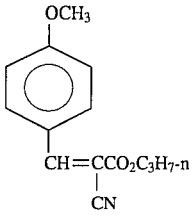

H-1:
$CH_2(SO_2CH{=}CH_2)_2$

The side of the support opposite to that described above may contain magnetic recording layers, antistatic layers, subbing layers, lubrication layers, and the like as described in U.S. Pat. No. 5,395,743, assigned to the same assignee as this application, and incorporated herein by reference.

The sample exhibits excellent wet adhesion (no removal in AO abrasion) and excellent dry adhesion, before and after C41 photographic processing.

What is claimed is:

1. An imaging element comprising a light-sensitive imaging layer and a polyester film support having coated thereon greater than 0.17 gm/m$^2$ of a layer of a self-crosslinking polyurethane derived from an isocyanate terminated prepolymer extended with an aliphatic polyamine and end-capped with N-methylol hydrazide groups, the prepolymer being derived from (a) a diisocyanate, and (b) a polyester polyol and having pendant water dispersing, carboxylic salt groups on the polymer chain and a hydrophilic colloid layer coated on the layer of self-crosslinking polyurethane.

2. The imaging element of claim 1 wherein the hydrophilic colloid is gelatin.

3. The imaging element of claim 1 wherein the diisocyanate is aliphatic.

4. The imaging element of claim 1 wherein the polyester polyol is aliphatic.

5. The imaging element of claim 1 wherein the isocyanate terminated prepolymer contains units derived from melamine.

6. The imaging element of claim 4 wherein the aliphatic polyester polyol is a derivative of neopentyl glycol, hexanediol, and adipic acid.

7. The imaging element of claim 6 wherein the prepolymer contains units derived from melamine.

8. The imaging element of claim 1 wherein the light-sensitive imaging layer contains silver halide.

9. The imaging element of claim 1 wherein the light-sensitive layer is applied on the hydrophilic colloid layer.

10. The imaging element of claim 1 wherein the polyester film support is treated with corona discharge, UV, glow discharge, or flame.

* * * * *